United States Patent [19]

Tuckey

[11] Patent Number: 4,770,131

[45] Date of Patent: Sep. 13, 1988

[54] FUEL INJECTOR FOR TWO-STROKE ENGINE

[75] Inventor: Charles H. Tuckey, Cass City, Mich.

[73] Assignee: Walbro Corporation, Cass City, Mich.

[21] Appl. No.: 46,674

[22] Filed: May 7, 1987

[51] Int. Cl.[4] ..... F02B 33/04

[52] U.S. Cl. ..... 123/73 A; 261/78.1

[58] Field of Search ..... 123/73 A, 73 V; 261/35, 261/78.1, DIG. 51

[56] References Cited

U.S. PATENT DOCUMENTS

| | | | |
|---|---|---|---|
| 2,020,778 | 11/1935 | Gregg | 261/DIG. 51 |
| 2,834,587 | 5/1958 | Goodyear | 261/78.1 |
| 3,859,967 | 1/1975 | Turner et al. | 123/73 A |
| 4,159,014 | 6/1979 | Szott et al. | 261/DIG. 51 |
| 4,422,423 | 12/1983 | Sugiyama et al. | 261/78.1 |
| 4,671,220 | 6/1987 | Inoue et al. | 123/73 A |

*Primary Examiner*—Charles J. Myhre
*Assistant Examiner*—David A. Okonsky
*Attorney, Agent, or Firm*—Barnes, Kisselle, Raisch, Choate, Whittemore & Hulbert

[57] ABSTRACT

A pulse fuel injector for a two-stroke internal combustion engine which utilizes a throttle body with a fuel venturi and a throttle valve in the body. A one-way pulse passage connects the crankcase of the engine and the venturi to direct air pulses to the venturi to aspirate fuel into the throttle body where it is drawn into the crankcase for transfer to the firing chamber of the engine.

5 Claims, 1 Drawing Sheet

FUEL INJECTOR FOR TWO-STROKE ENGINE

FIELD OF INVENTION

Fuel supply for internal combustion engines.

BACKGROUND AND OBJECTS OF THE INVENTION

In the art of providing fuel, namely, hydrocarbons to internal combustion engines, there is a long standing history of the use of carburetors to discharge a mixture of air and fuel to the cylinders of an engine. In what is termed a "two-cycle engine" fuel has been provided by introducing it into the crankcase of the engine through a reed valve. The two-cycle engine, invented by Dugald Clerk in 1878, utilizes transfer passages to carry air and fuel to the firing chamber from the crankcase. With the recent adoption of fuel injection devices, the use of carburetors has decreased in four-cycle engines.

It is an object of the present invention to adapt the use of a fuel injector system to a two-cycle engine. Another object of the invention is the provision of a fuel system for two-cycle engines which will be independent of the attitude of the engine; that is, the fuel system will operate equally well when the engine is turned on its side or upside down as may be the case in use on chain saws or weed cutters.

Other objects and features of the invention will be apparent in the following description, accompanying drawings, and claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
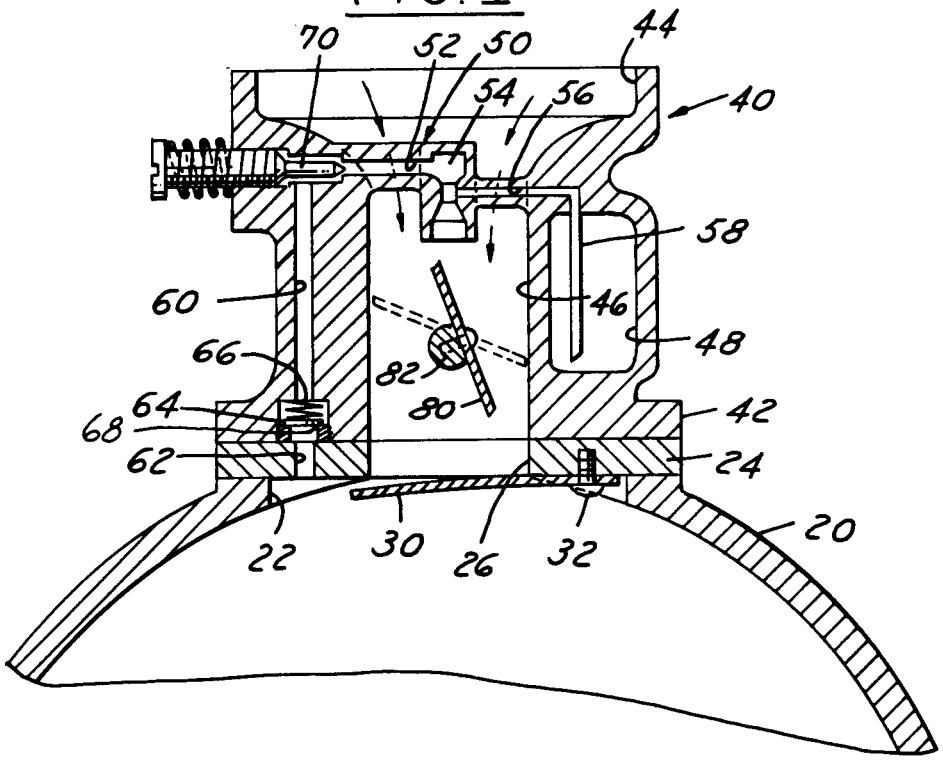
FIG. 1, a sectional view of an engine and fuel supply system.

With reference to FIG. 1 of the drawings, a two-cycle engine is shown in cross-section with a crankcase housing 20 with an intake port 22 on the peripheral edge of which is a reed valve plate 24. A central opening 26 in the plate 24 is regulated by reed valve 30 secured to the plate by one or more screws 32.

On the outside of the plate 24 is also mounted a throttle housing 40 with a mounting flange 42 secured to the plate 24 and the engine housing by suitable bolts not shown. The throttle body housing 40 has an air inlet opening 44 opposite the mounting end which leads to a venturi passage 46 open to the reed valve 30. A fuel chamber 48 is formed in the housing 40 which can be either a float chamber or a metering diaphragm fuel chamber.

As part of the housing 40, a bridging element 50 extends diametrically across the throttle passage 46. The bridging element 50 has a pulse passage 52 which leads to an axial hour glass shaped chamber 54 opening to passage 46. A second fuel passage 56 opens to the throat of passage 54 and connects to a tube 58 depending into chamber 48.

On the other side of the housing 40 is a pulse passage 60 parallel to the throttle passage 46 and open to a short port 62 in plate 24. A one-way check valve 64 backed by a spring 66 acts against a seat 68 in a recess at one end of passage 60. At the other end of passage 60 is a needle valve 70 to control the area of access at the end of passage 52 leading to passage 54.

A throttle valve plate 80 is mounted for open and close movement on shaft 82 in passage 46.

Figure 2:
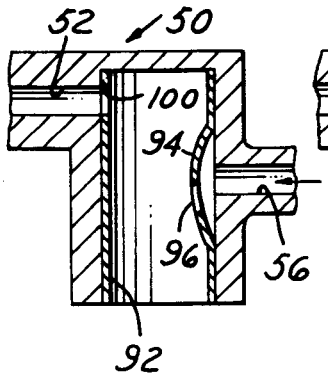
FIGS. 2, 3 and 4, respectively, illustrate modified fuel delivery tubes for use with the fuel injection system.
Figure 3:
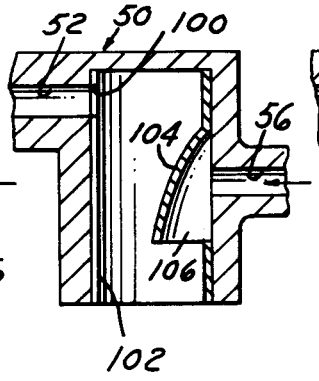
Figure 4:
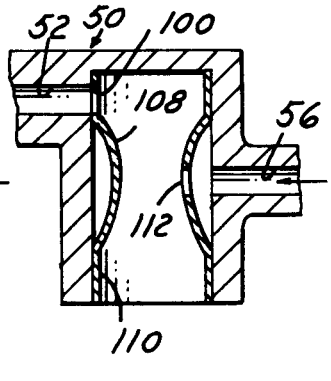

The hour glass or venturi passage 54 can be termed an injector signal intensifier and the fuel passage 56 enters at the restricted venturi portion. In FIGS. 2, 3 and 4, additional modifications of intensifiers are shown. These consist of tubular units. The open-ended tubes have a frictional fit into a cylindrical opening in the bridge element 50 and, when installed, the upper end of the tube is closed. A tube 92 (FIG. 2) has a frictional fit in the bridge element and each tube has a different configuration. In FIG. 2, the tube 92 has an inward bulge 94 with a port 96 so that the effect is that of a venturi. In each case a port 100 connects to the pulse passage 52.

In FIG. 3, the tube 102 has a bulged-in portion 104 open at the downstream end 106. In FIG. 4 an annular restriction 108 is formed in the tube 110 with an opening 112 to the fuel passage 56.

IN THE OPERATION

Fuel in the fuel chamber 48 will be aspirated through the tube 58 and passage 56 to the throttle controlled air passage 46 when air pulses from the crankcase 20 are transmitted through check valve 64 and passages 60, 52 and the venturi chamber 54. In this phase the reed valve 30 is momentarily closed but opens to allow the fuel to reach the crankcase and be transferred in the usual way to the firing chamber of the cylinder of the engine.

Thus, fuel injection is achieved by the rapid pulse from the crankcase followed by the conventional fuel transfer to the cylinder. This system will operate on either a single cylinder two-cycle engine or a double cylinder engine. The speed of the engine is controlled by the position of the throttle valve 80 which regulates the air flow into the crankcase of the engine.

What is claimed is:

1. A fuel injection system for a two-cycle engine having a crankcase chamber subject to repetitive high and low pressure phases which comprises:

(a) a throttle body having a first fuel and air passage open to the crankcase chamber to furnish a combustible fuel and air mixture to the engine, (b) a valve to close said first passage under conditions of pressure in said crankcase chamber, (c) a source of liquid fuel adjacent said throttle body, (d) an aspirator adjacent said first air passage of said throttle body having a fuel and air passage with a first end upstream from a restricted portion, and a second end downstream of said restricted portion and open to said first passage, (e) means forming a second passage connecting said restricted portion of said aspirator to said fuel source, and (f) a third passage open at one end to said crankcase chamber and open at the other end to the first end of said aspirator, whereby elevated pressure in said crankcase chamber will transmit a pulse through said third passage to aspirate a fuel charge from said source of fuel through said second passage to said first fuel and air passage.

2. A fuel injection system as defined in claim 1 in which a one-way check valve is positioned in said third passage to pass elevated pressure pulses from said crankcase chamber to said third passage and block sub-atmospheric pulses from said third passage.

3. A fuel injection system as defined in claim 1 in which an adjustable control is provided in said third passage to modulated air pulses in said third passage delivered to said aspirator.

4. A fuel injection system as defined in claim 1 in which said aspirator is located in a bridge element extending across said first fuel and air passage oriented axially of said first passage, said bridge element having a transverse pulse passage as a portion of said third passage and a transverse fuel passage as a portion of said second passage.

5. A fuel injection system for a two-cycle engine having a crankcase chamber which comprises:

(a) a throttle body having a first fuel and air passage open to the crankcase chamber of the engine, (b) a valve to close said first passage under conditions of pressure in said crankcase chamber, (c) a source of liquid fuel adjacent said throttle body, (d) an aspirator adjacent said first air passage of said throttle body having a restricted portion, (e) means forming a second passage connecting said restricted portion to said fuel source, and (f) a third passage connecting said crankcase chamber and said aspirator, whereby elevated pressure in said crankcase chamber will transmit a pulse to said third passage to aspirate a fuel charge from said source of fuel to said first fuel and air passage, (g) said aspirator being located in a bridge element extending across said first fuel and air passage oriented axially of said first passage, said bridge element having a transverse pulse passage as a portion of said third passage and a transverse fuel passage as a portion of said second passage, (h) said aspirator being comprised of a tube open at each end installed in said bridge between said pulse passage and said fuel passage, said tube being closed at one end by said bridge and having a wall portion bulged inwardly to form a venturi restricted and a fuel outlet adjacent said bulged portion open to the other end of said tube which is open to said first passage.

* * * * *